US007386956B2

(12) United States Patent
Argila

(10) Patent No.: US 7,386,956 B2
(45) Date of Patent: Jun. 17, 2008

(54) DEVICE FOR DIRECTING MORTAR DROPPINGS/DEBRIS, PROTECTING A DRAINAGE WEEP DEVICE AND DRAINING WATER FROM A SINGLE WYTHE WALL, THE SINGLE WYTHE WALL PROVIDED WITH THE DEVICE, AND METHOD OF DRAINING WATER FROM THE SINGLE WYTHE WALL

(76) Inventor: Anthony Argila, 121 Sunrise Dr., Massapequa, NY (US) 11758

( * ) Notice: Subject to any disclaimer, the term of this patent is extended or adjusted under 35 U.S.C. 154(b) by 493 days.

(21) Appl. No.: 10/800,374

(22) Filed: Mar. 12, 2004

(65) Prior Publication Data

US 2005/0155309 A1 Jul. 21, 2005

Related U.S. Application Data

(60) Provisional application No. 60/537,734, filed on Jan. 20, 2004.

(51) Int. Cl.
*E04B 1/70* (2006.01)
*E04D 19/00* (2006.01)

(52) U.S. Cl. ..... 52/169.5; 52/302.3

(58) Field of Classification Search ..... 52/169.5, 52/302.1, 302.3, 302.4, 405.1, 606
See application file for complete search history.

(56) References Cited

U.S. PATENT DOCUMENTS

| | | | | |
|---|---|---|---|---|
| 2,934,931 A | | 5/1960 | Johnson | |
| 3,019,560 A | | 2/1962 | Hansen | 50/342 |
| 4,486,986 A | * | 12/1984 | Cosenza | 52/169.5 |
| 4,612,742 A | * | 9/1986 | Bevilacqua | 52/169.5 |
| 4,852,320 A | | 8/1989 | Ballantyne | 52/303 |
| 4,907,385 A | * | 3/1990 | Biodrowski | 52/302.3 |
| 4,910,931 A | | 3/1990 | Pardue, Jr. | 52/169.5 |
| 5,230,189 A | * | 7/1993 | Sourlis | 52/169.5 |
| 5,274,968 A | | 1/1994 | Pardo | 52/97 |
| 5,343,661 A | | 9/1994 | Sourlis | 52/169.5 |
| 5,598,673 A | | 2/1997 | Atkins | 52/302.1 |
| 5,860,259 A | | 1/1999 | Laska | 52/302.3 |
| 5,870,864 A | | 2/1999 | Snyder et al. | 52/169.5 |

(Continued)

OTHER PUBLICATIONS

Masonry Technology Incorporated, "Weep Systems and Moisture Control Devices for Concrete Masonry Construction", 1999, brochure, www.masonrytechnology.com, 5 pages.

(Continued)

*Primary Examiner*—Robert Canfield
*Assistant Examiner*—Christine T Cajilig
(74) *Attorney, Agent, or Firm*—Alfred M. Walker

(57) ABSTRACT

A device for protecting weep channels of masonry blocks of a single wythe wall, each block forming at least one inner hollow cell. A plurality of upwardly extending water-permeable bodies is provided for the hollow cells, each of the bodies having a plurality of passages such as to permit water to pass through the passages to prevent passing of mortar and other debris through the passages and to protect the drainage weep hole channels. Preferably each of the bodies has a transverse dimension which decreases upwardly from a lower transverse cross section to cover a draining channel and to direct falling mortar and other debris in the inner hollow cells of each masonry block of the single wythe wall, onto a surface of each of the upwardly extending water-permeable bodies.

23 Claims, 5 Drawing Sheets

U.S. PATENT DOCUMENTS

| | | | | |
|---|---|---|---|---|
| RE36,676 | E | 5/2000 | Sourlis | 52/169.5 |
| 6,202,366 | B1 | 3/2001 | Snyder et al. | 52/97 |
| 6,256,955 | B1 | 7/2001 | Lolley et al. | 52/302.3 |
| 6,584,746 | B1 | 7/2003 | Hohmann et al. | 52/513 |
| 6,912,820 | B2 * | 7/2005 | Sourlis | 52/302.1 |
| 2004/0182037 | A1 * | 9/2004 | Sourlis | 52/606 |

OTHER PUBLICATIONS

"Blocknet by Mortar Net, Single Wythe Block Wall Drainage System Installation Instructions", Mar. 2, 2004, www.mortarnet.com/BlockNetInstallation.asp, 4 pages.

The Mortar Net Block Drainage System, Prevent Water Infiltration of Concrete Masonry Walls, 2004, brochure, 2 pages.

Sandell Manufacturing Co., Inc., "Copper Thru-Wall Flashing", 2004, catalog excerpt, 4 pages.

Mortar Net, Mortar Net Block, May 2003, www.mortarnet.com/mnblock.htm, 3 pages.

Sandell Manufacturing Co., Inc., Sandell's Blok-Flash, 2004, www.sandellmfg.com, catalog excerpt, 1 page.

Sandell Manufacturing Co., Inc., "Sandell's Weep Tubes & Cell Vents", 2004, www.sandellmfg.com, catalog excerpt, 2 pages.

"A New Technology At It's Best", Bloknet by Mortar Net, 1 page advertisement, *Masonry Construction* magazine, Feb. 2004, p. 16.

* cited by examiner

DEVICE FOR DIRECTING MORTAR DROPPINGS/DEBRIS, PROTECTING A DRAINAGE WEEP DEVICE AND DRAINING WATER FROM A SINGLE WYTHE WALL, THE SINGLE WYTHE WALL PROVIDED WITH THE DEVICE, AND METHOD OF DRAINING WATER FROM THE SINGLE WYTHE WALL

RELATED APPLICATIONS

This application is based upon provisional patent application No. 60/537,734 dated Jan. 20, 2004, and claims benefit under 35 U.S. Code section 119(e).

FIELD OF THE INVENTION

The present invention relates to a device for directing mortar droppings/debris from an inner cell/cavity of a single wythe wall and draining water therefrom, to a single wythe wall provided, with the device, and to a method of draining water from a single wythe wall and preventing mortar dropping debris from clogging drainage weep holes therein.

BACKGROUND OF THE INVENTION

Although they come in a variety of shapes and sizes, concrete masonry units are generally similar in design. Blocks are generally hollow units made of cement with hollow cores called cells. The outside surfaces of the block units are called face shells, and they are connected by cross webs. Each block generally consists of 2 face shells (inner and outer), 3 cross webs (one at each end and one in the middle) and two cells divided by the middle cross web. These cells are where the moisture/water problems occur. Water passes through the outer face shell settles and collects at the base of the wall in the open cells with no means of escape.

Despite stability and strength of masonry walls, water penetration in masonry wall design is a major contributing factor to the wall's overall performance and ultimately to the life of the wall. In the masonry trade nomenclature, masonry wall construction consists of two types of walls, namely a single wythe wall and a cavity wall. Cavity walls are designed with two wythes of masonry consisting of an outside masonry block unit course and an inside masonry block unit course. A "course" is defined as a layer of concrete blocks or other masonry units laid end to end adjacent to each other.

Furthermore, unlike the common definition of a "cavity" being an open recess, in the masonry trade, a "cavity" refers specifically to the longitudinally extending cavity which separates the two walls of a double wythe wall construction. In a standard cavity wall design, having both an inner and outer wythe wall, a flashing and a weep hole course at the base of the wall directs water which may penetrate the outer wythe back out away from the inner cavity between the two wythe block walls.

Devices have been proposed for draining water from the cavity walls, such as for example, disclosed in U.S. Pat. No. 5,230,189 of Sourlis, U.S. Pat. No. RE36,676 of Sourlis; U.S. Pat. No. 6,584,746 of Hohmann; U.S. Pat. No. 6,256,955 of Lilley; U.S. Pat. No. 3,019,560 of Hansen; U.S. Pat. No. 4,852,320 of Ballantyne; U.S. Pat. No. 5,274,968 of Pardo; U.S. Pat. No. 5,343,661 of Sourlis; U.S. Pat. No. 5,598,673 of Atkins, U.S. Pat. No. 5,860,259 of Laska, U.S. Pat. No. 2,934,931 of Johnson and also as sold under the tradename MORTAR NET®.

In contrast to double wythe cavity wall constructions, a single wythe wall design consists of only one wythe of masonry blocks, wherein each block has one or more hollow core units with hollow recesses known as cells.

The need for a product of the present invention is a direct result of standard installation procedure of masonry units in the construction of single wythe masonry walls. Blocks are laid one on top of another with a mortar joint separating each unit. This mortar joint, which separates the unit, is spread on top of the block webs on the inner and outer face shell when each block is laid. Mortar is placed with a trowel and spillage occurs when the mortar is spread, known as mortar droppings. These mortar droppings fall both inside and outside of the hollow block cells. The location of the droppings, which fall within the hollow block cells, is where the problem occurs. These mortar droppings fill up within the bottom cells of the base of the wall and clog up the cells, preventing drainage therefrom through weep hole drainage ducts.

Even with flashings and weep designs, the mortar droppings occur and clog any passage of water weeping back out of the wall.

It has been attempted to stop moisture penetration through single wythe walls with such materials as integral water repellent admixtures and surface applied coatings, which however have not been 100% successful. Even flashing and weep hole courses have been attempted with little or no success.

"Weep holes" are generally configured as water drainage channels and tubes, of all shapes and sizes, which for the most part all are each installed at the head/cross joint of the masonry units (such as blocks).

Efforts to prevent mortar debris from accumulating in hollow cells of single wythe block walls also include the use of flat trays, such as described in U.S. Pat. No. 6,202,366 of Snyder, and such as known as "Blok Flash", which completely cover the open cell of a block. These flat trays do not extend upwardly within the hollow cells of each block. Substantially flat, slightly concave trays are disclosed in U.S. Pat. No. 4,910,931 of Pardue. However, since these flat trays are flat or substantially flat, they can accumulate a complete layer from side to side of mortar droppings thereon, cutting off water drainage from weep holes, thus allowing water to accumulate within the cells of the wall and to cause major damage to the block walls by seeping through the inner face shell of the single wythe wall and into the building.

BLOCKNET® is another new product which has attempted to prevent water infiltration back out of the open cells of blocks. However, BLOCKNET® has the same disadvantages as the other products on the market today. It is a system that is comprised of metal flashing, with a horizontal mesh element adhered to the top of it, which sits at the bottom base of the wall. Along with this is another thin vertical mesh element which must be installed against the backside of the face shell within the cell of the block.

Disadvantages with this product include the fact that the metal flashing, with a mesh element adhered to it, must be set at the bottom base of wall, prior to any mortar being spread. The first step potentially presents the major down fall. This means mortar has to be spread over the metal flashing with the mesh element located at the bottom of the hollow cells of each concrete masonry block. Mortar droppings will inevitably occur, and just the procedure of spreading mortar over the flashing, may clog the weep drainage device. As stated in Step 4 of the installation procedure of the BLOCKNET® literature, the next step is installing the mesh element in the first course of blocks, which must be installed against the face of each hollow core/cell. This then leaves the base of the cell open and unprotected from mortar droppings, falling and clogging the flashing and weep hole channel device at the base of the cells of each masonry block.

Another device is CAVITY VENT® of Masonry Technology Incorporated, which has attempted the relieving of water infiltration back out of the wall or block cells. However, this product also sits at the base of the wall with little or no protection from falling mortar droppings and debris from above. It is a corrugated material, with channels, which weeps water to the outside from the cell area of the block. But just as other devices fail because a lack of adequate protection from the mortar droppings caused by the spreading of mortar, this can fail also under mortar accumulation.

Another attempt to prevent clogging of weep holes in single wythe construction is disclosed in the "Mortar Net Block Drainage System" which requires a cavity wall construction of two walls spaced apart from each other, together with a flashing at the base course of the wall. The flashing separates the two-walled base cavity wall course from the single wythe courses above. But, the necessity for the flashing, at the base, causes a major weakness in the wall, because the mortar doesn't bond to the flashing separating the block courses.

At the same time it should be mentioned that single wythe block structures make up almost 50% of all masonry buildings today. Single wythe concrete block walls are one of the fastest, strongest, most popular and cost effective building designs in the construction field today coming in at about 30% less than cavity wall construction. Therefore, there is a need to prevent clogging of weep hole channels at the base of each single wythe masonry block course.

OBJECTS OF THE INVENTION

Accordingly, it is an object to the present invention to provide a device for directing mortar droppings/or debris, protecting weep drainage device associated therewith, and draining water from an inner hollow cell of a single wythe wall, which eliminates the disadvantages of the prior art.

It is also another object of the present invention to provide a single wythe wall which is provided with a device for directing mortar debris/droppings, protecting a weep drainage device associated therewith and draining water from the single wythe wall.

Finally, it is also an object of the present invention to provide a method of directing mortar droppings/debris from a single wythe wall, protecting a weep device associated therewith and draining water from the single wythe wall.

Finally, it is also an object of the present invention to improve over the disadvantages of the prior art.

SUMMARY OF THE INVENTION

In keeping with these objects and with other which will become apparent hereinafter, one feature of the present invention resides, briefly stated, in a device for drainage, draining water therefrom and protecting drainage weeps, and for directing mortar droppings/debris away from the weep hole drainage channels of a single wythe wall composed of a plurality of linearly extending courses of structural masonry block elements, each forming at least one inner hollow cell recess communicating through at least one drainage weep hole channel with the outside.

The device includes a plurality of discrete water-permeable bodies, each insertable in a respective one of the inner hollow recesses of the hollow cells of the masonry blocks. Each of the discrete water-permeable bodies has a plurality of passages, such as to permit water to pass through the passages, and yet to at the same time prevent passing of mortar and other debris through the passages.

Preferably each of the water-permeable bodies has a transverse dimension which decreases upwardly from a lower transverse cross-section, so as to cover and protect the drainage weep hole channel at the lower transverse cross section thereof, and to allow falling of the mortar and other debris in the inner hollow cells of the masonry blocks onto a surface of each of the water-permeable bodies, but at the same time to prevent falling of the mortar and other debris into the inner hollow cells and thereafter into the respective drainage weep hole channels, whereby water in each of the inner hollow cells of the single wythe wall can flow through a respective one of the bodies into the drainage weep hole channel, and outside of the single wythe wall.

It is another feature of the present invention to provide a single wythe wall, comprising a plurality of structural elements, such as cement masonry blocks, placed over one another and each forming at least one hollow recess communicating with the outside through at least one drainage channel or weep hole device; and a device for draining water from the hollow recesses, and including a plurality of debris collecting, water-permeable bodies, each inserted in a respective one of the inner hollow recesses of the single wythe cement masonry blocks and each body having a plurality of porous passages, such as to permit water to pass through the passages, and yet also to prevent passing of mortar and other debris through the water-permeable passages.

In a preferred embodiment, each of the water-permeable bodies is fibrous and has a tapered transverse dimension which decreases upwardly from a lower transverse cross-section, and protects the lower base of the cell so as to cover the weep hole channel by the lower transverse cross section of the respective cells of each masonry block, and to allow falling of the mortar and other debris into the inner hollow recess, onto a debris-collecting surface of each of the water-permeable bodies, but at the same time to prevent falling of the mortar and other debris in the inner hollow recess cells of each block leading into the drainage channel, whereby water in each of the inner hollow recess cells of the single wythe wall can flow through each respective water-permeable body, into each drainage weep hole channel, and outside of the single wythe wall.

The feature of the special tapered shape with a transverse dimension decreasing upwardly from the lowest transverse cross section at the bottom, allows mortar droppings/debris to be directed as they fall to a location upon the preferably fibrous, upwardly extending water-permeable body within the cell of each masonry block, and not clog the weep hole drainage channel device and allow any water penetration into the cell back out through the weep hole drainage channel device.

It is a further feature of the present invention to provide method of draining water from a single wythe wall having a plurality of structural masonry block elements placed over one another and each having hollow cells forming at least one inner hollow recess communicating with outside through at least one weep hole drainage channel. This method includes the steps of introducing into the inner hollow recess cells of the masonry blocks a plurality of upwardly extending water-permeable bodies each inserted in a respective one of the inner hollow cells of each masonry block and having a plurality of passages such as to permit water to pass through said passages, but yet being able to prevent passing of mortar and other debris through the passages of upwardly extending water-permeable bodies, and preferably forming each of the bodies with a tapered transverse dimension which decreases upwardly from a lower transverse cross-section, so as to cover the drainage channel by the wider lower transverse cross section and to allow falling of the mortar and other debris in the inner hollow cell recess onto a surface of each of the fibrous bodies, whereby water in each of the inner hollow cells of the masonry blocks of the single wythe wall can flow through each respective fibrous body, into the drainage channel and outside of the single wythe wall.

With the solutions proposed in accordance with the present invention, water (moisture) can be reliably drained from the interior of the single wythe wall, despite mortar and other debris falling into its inner cavities.

The product of the present invention is a system with a simple solution, which has plagued the industry for more than a decade. This is why it is preferably configured with its most important pyramid shape with a square or rectangular crossection at the base filling the area of each open cell of each block. Other embodiments include tapered conical shapes covering most of the area of each open cell, or square or rectangular bases having upwardly extending shapes having crossections smaller than the lower base crossections. This aids in the prevention of any water collecting within the cells caused by mortar droppings, therefore preventing any clogging of the weep system device. If water is given a path of least resistance, it will flow easily in the direction provided. The special pyramid shape allows the mortar droppings to fall and collect without clogging the base of the cell where the water is weeped out.

The product of the present invention works directly at the problem of the block cells by preventing any mortar droppings from clogging the cell therefore allowing any water penetration to freely escape through a standard designed weep hole positioned directly at the base of the cell, not at a joint like most other weep holes.

Other positive aspects of this product are its versatility. It is easy to install. There are no layout requirements or special personnel needed. It does not require a double wythe base course with flashing, which means a stronger wall (when a mason installs a flashing course it breaks the bond between the units. The mortar does not adhere to the flashing, making a weak link at the base of the wall).

It can be used with both insulated and non-insulated units. It can also be used in conjunction with vertically reinforced walls, which is an important design criteria requirement of the latest building code specifications.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The present invention can best be understood in connection with the accompanying drawings, in which:

FIGS. 3, 4, 5 and 6 are perspective views showing various embodiments for different tapered vertical shapes of the upwardly extending body for draining water and directing mortar debris from a single wythe wall, in accordance with the present invention wherein:

FIG. 3 is a perspective view showing one of the fibrous, upwardly extending water-permeable bodies having a conical shape;

FIG. 4 is a perspective view of another embodiment showing an upwardly extending body with a truncated pyramid shape upon a bar;

FIG. 5 is a perspective view of another embodiment showing an upwardly extending body with a truncated conical shape upon a base;

FIG. 6 is a perspective view of another embodiment showing an upwardly extending body with discrete stepped members of decreasing upward crossections;

DESCRIPTION OF THE PREFERRED EMBODIMENTS

Figure 1:
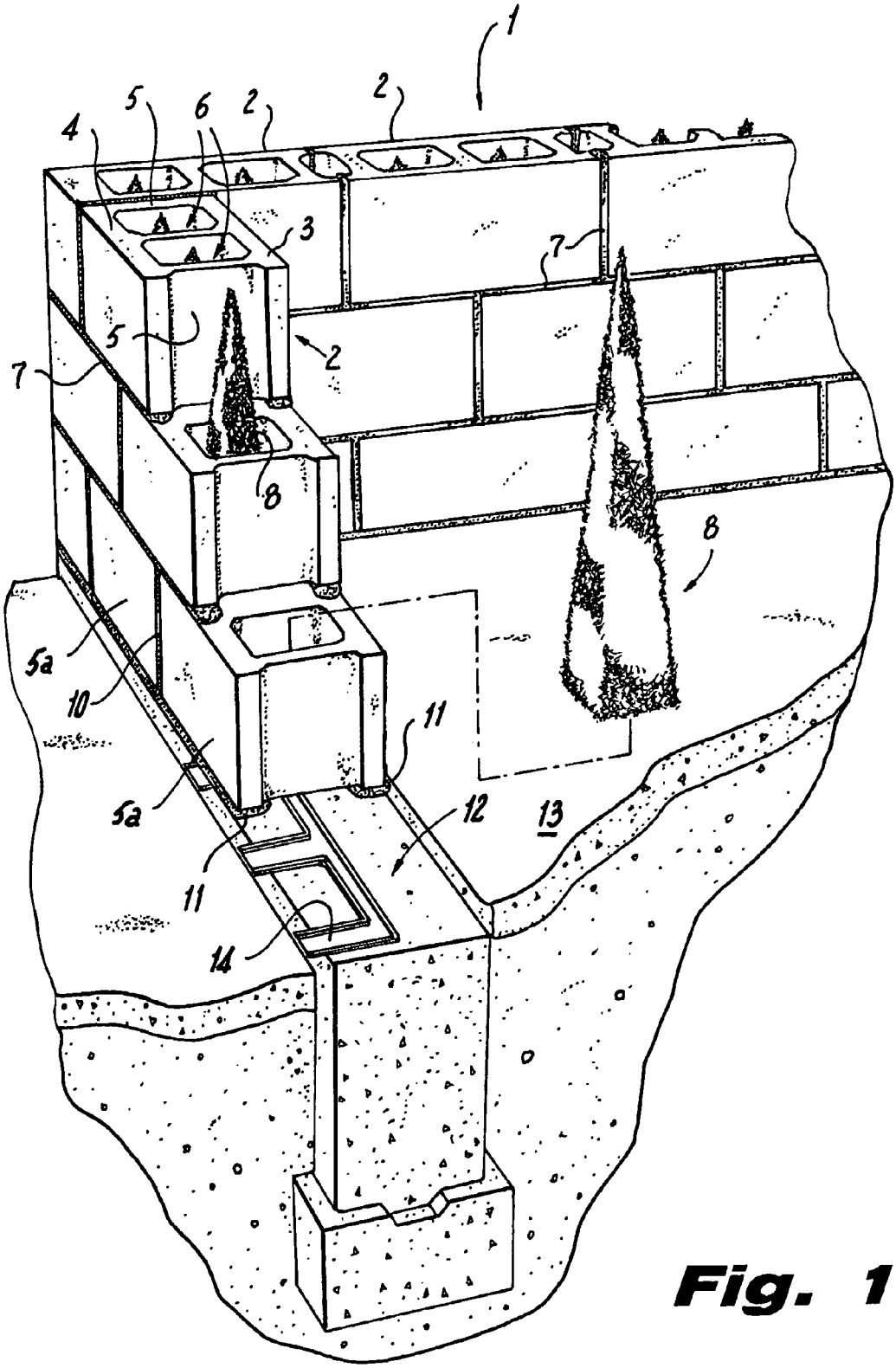
FIG. 1 is a perspective partial cutaway view, showing a single wythe masonry wall with a plurality of preferably fibrous, upwardly extending water-permeable bodies directing mortar droppings and debris away from drainage weep holes within the single wythe masonry wall, thereby preventing the clogging of the weep hole devices and for draining water from hollow recess cells of the masonry blocks of the single wythe wall, in accordance with the present invention.

FIG. 1 is a perspective cutaway view showing a single wythe masonry wall which is identified as a whole with reference numeral 1. The single wythe wall 1 is composed of a plurality of structural masonry elements 2 each formed as an integral structural element or block having an inner face shell 3, an outer face shell 4 and three cross webs 5 forming two inner hollow recesses known in the masonry trade as cells 6, which are separated from one another by the middle cross webs 5.

The masonry blocks 2 are laid one on top of another with a mortar joint 7 separating the blocks from one another. Mortar joint 11 separates the bottom row of blocks 5*a* from foundation wall 12. As clearly illustrated in FIG. 1, no flashing is used between the bottom row of blocks 5*a* and the top surface of foundation wall 12 secured in the around 13. The mortar joint 7 which separates the blocks is spread on sides of the webs 5 and on the inner and outer face shells 3, 4 when each block is laid. Mortar is placed with a trowel and spillage occurs when the mortar is spread. This spillage is known as mortar droppings. These droppings fall both inside and outside of the hollow block cells. The droppings which fall inside the hollow inner recess formed by cells 6 cause problems since conventionally they fill up the bottom cells 6 of the single wythe wall 1, at the base of the single wythe wall, and clog up the bottom cells 6, where weep hale channel devices 14 are located on the top surface of the foundation wall 12.

In accordance with the present invention a plurality of fibrous or texturized upwardly extending, water-permeable bodies are provided, as identified with reference numeral 8. Each body 8 has a bottom 9 and preferably a transverse dimension with decreases from the lowest transverse cross section at the bottom in a vertical upward direction as shown in FIGS. 2-6.

In a preferred embodiment, the height of each body 8 exceeds the height of each masonry block 2, and more preferably is at least the height of two courses of masonry blocks 2. The reason for this is that mortar droppings might exceed the height of one course, thereby completely blocking the weep channel.

Figure 7:
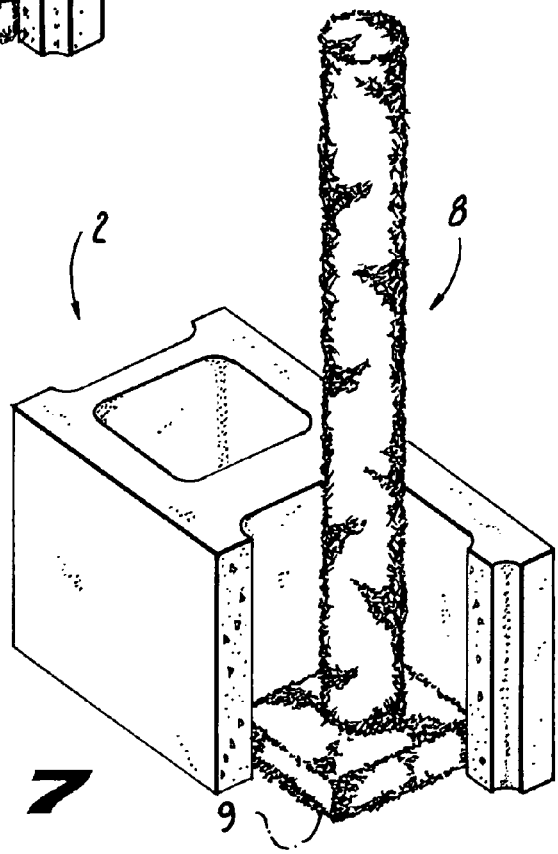
FIGS. 7 and 8 are perspective views showing various shapes for upwardly extending water-permeable bodies not having a taper, such as an upwardly extending cylindrical masses with a round crossection, as in FIG. 7, or an upwardly extending mass with a square or rectangular crossection, as in FIG. 8; each extending upward from a base which fills the base of each hollow cell of each masonry block; and, FIG. 9 is a view showing a section of the single wythe wall with the inventive upwardly extending body installed in a corresponding hollow recess of the wall.
Figure 8:
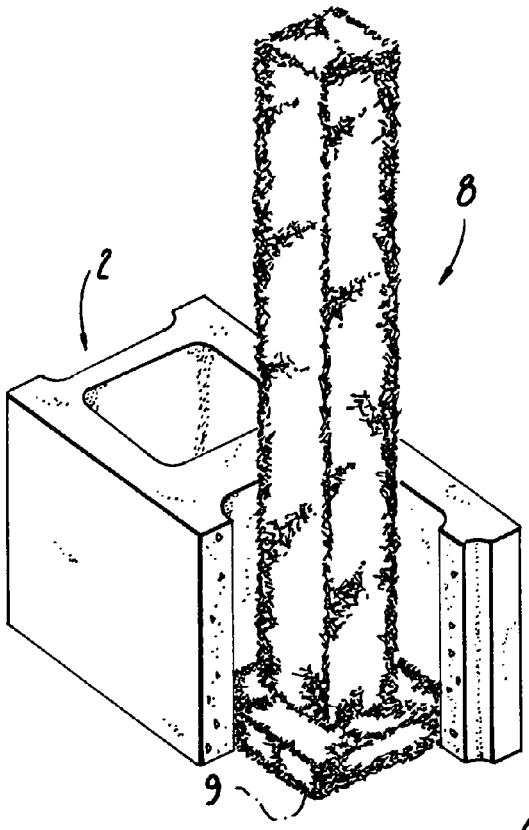
Figure 9:
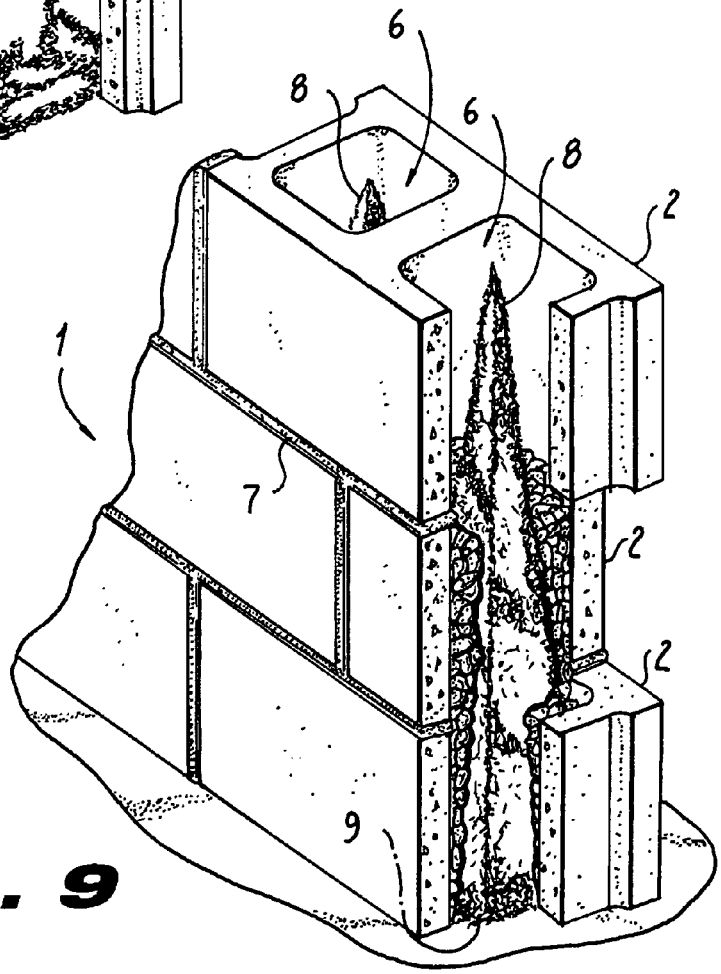

Other non-tapered configurations with geometric shaped member extending above a base may be used with lesser value, such as shown in FIGS. 7 and 8 herein. For example, FIG. 7 shows an upwardly extending cylindrical tubular mass having a smaller crossection than base 9 upon which body 8 sits. However, base 9 covers the open crossection of the cell in which body 8 is placed. FIG. 8 shows a mass of body 8 of square or rectangular crossection above a square or rectangular base having a larger crossection. Furthermore, even if mortar were to accumulate on a top portion of the upwardly extending square or rectangular correctional mass or the cylindrical mass of body 8 and also upon the exposed portion of base 9, water could still flow horizontally through the portion of the block above the accumulated mortar droppings, and then downward to the weep hole channel and out of the masonry block.

Figure 2:
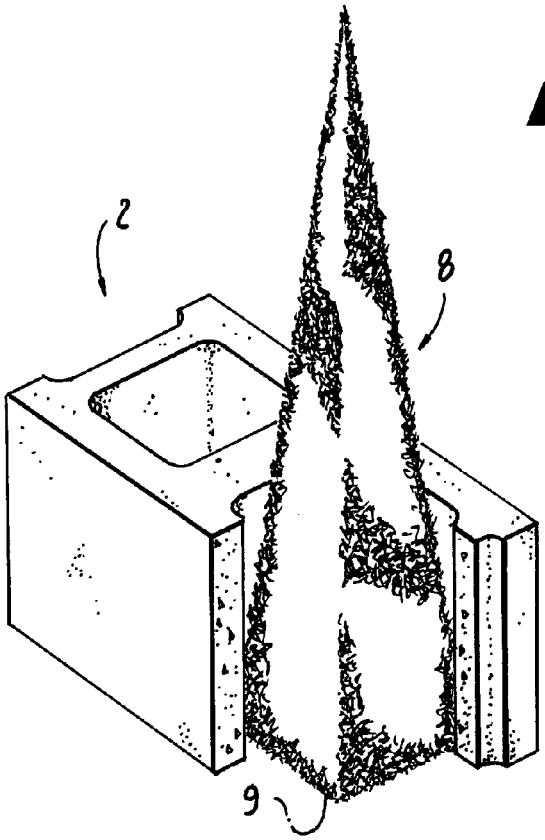
FIG. 2 is a perspective view showing one of the preferably fibrous, upwardly extending water-permeable bodies having a pyramid shape for catching mortar droppings, protecting weep channels and draining water from a single wythe wall cavity in accordance with the present invention.

As shown in FIG. 2, the fibrous, water-permeable body can preferably have a pyramidal shape with a transverse dimension decreasing upwardly from the above-mentioned lowest transverse cross section at the bottom.

Figure 3:
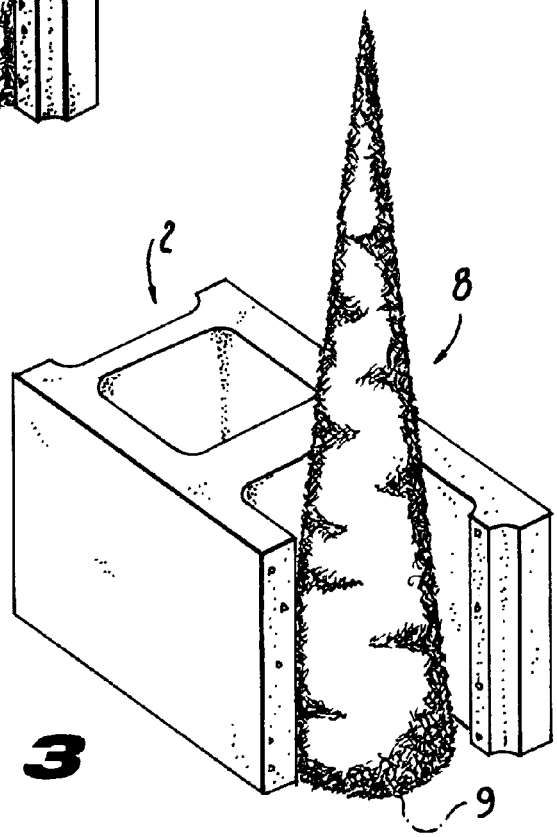
Figure 4:
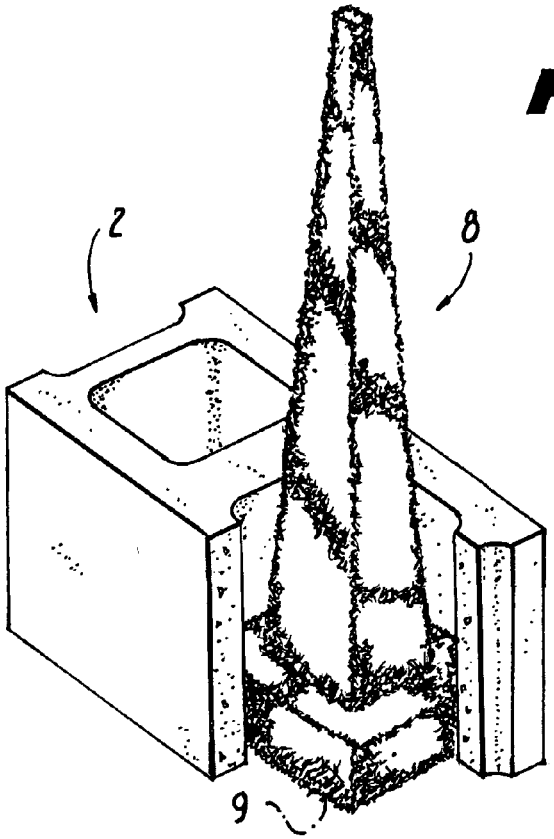
Figure 5:
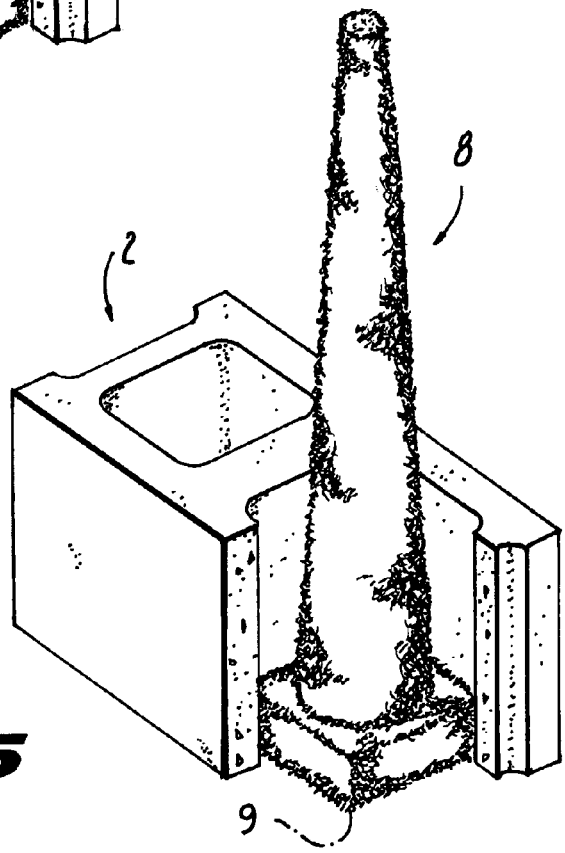
Figure 6:
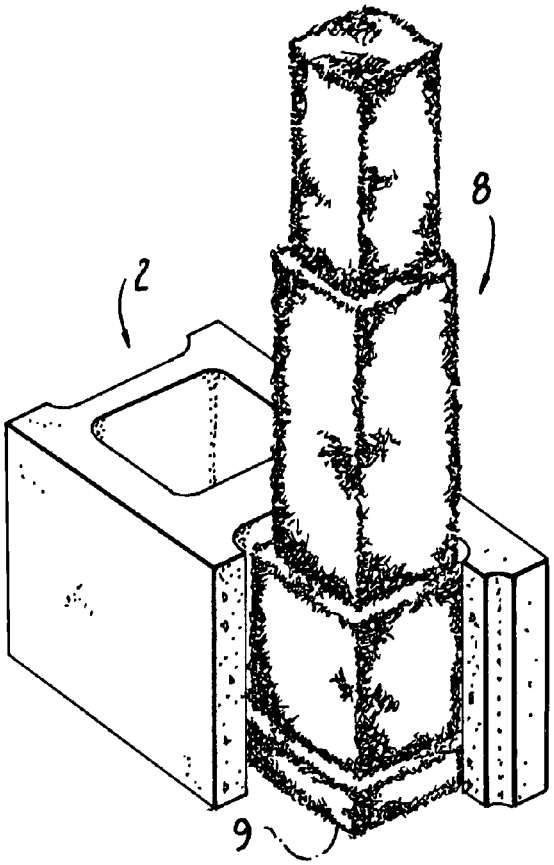

In accordance with another embodiment of the present invention shown in FIG. 3, each body 8 can have a conical shape with a transverse dimensions decreasing upwardly from the lowest transverse cross section. When a conical shape is used, preferably the circular diameter width of the cone of body 8 at its lower base contacts all four shell walls of each cell, thereby minimizing uncovered areas at the four corners of the base of each square or rectangular cell, so as to substantially cover the lower transverse area of the base of each cell.

Preferably the height of each body 8 exceeds the height of at least one block, or even more preferably exceeds the height of several blocks. The higher the height, the more surface area is provided to catch mortar droppings above the base of each cell, thereby preventing the complete closure of each cell by an accumulation of mortar droppings.

The fibrous, water-permeable bodies 8 are composed of a material which allows water to pass through the body but does not allow mortar and other debris to pass through the body. For example the bodies 8 can be composed of a fibrous open mesh made from recycled polyester with a flame-retardant adhesive to provide resiliency and strength. Other synthetic fibrous materials may be used, as well as rust-resistant metallic fibrous materials. While fibrous materials are preferred, it is anticipated that other non-smooth similar geometrically shaped bodies with texturized surfaces of barbs, grates and other irregular textures may be used to catch the mortar droppings.

The lowest transverse dimension 9 of each fibrous, water-permeable body 8 can substantially correspond to a transverse dimension of a lower square or rectangular end of the hollow recess cells in each of the masonry blocks 2. In this case the bottom 9 of each body 8 is held firmly by the surrounding cell walls of the lowest masonry block, and also reliably covers the draining channel or weep hole device, allowing any water penetration to freely escape through the weep hole positioned directly at the base of the cell where the water collects, not just at a cross joint 10 like other drainage weep holes.

When the fibrous, water-permeable body 8 is introduced into a corresponding hollow recess formed by cells of a plurality of the masonry blocks 2 laid over one another, a bottom 9 of the fibrous, water-permeable body is placed on top of the draining channel which communicates the corresponding cavity with the outside. As a result, when mortar and other debris fall inside the or upon the hollow masonry block cells, it can not enter the draining channel weep hole device or clog the channel. Instead, the mortar and other debris fall around or upon the outer surface of the fibrous or texturized, water-permeable bodies 8. As a result, the base of the masonry cell in which the fibrous, water-permeable body 8 is inserted is not clogged and the drainage weep hole channel leading from the base of the cell to the outside is also not clogged with mortar and other debris, and water which penetrates into the hollow cells passes through the fibrous or texturized, water-permeable body 8 downwardly to the base of the hollow cells of the masonry blocks, and further flows through the weep hole drainage channel which leads from the base of the hollow cells of the masonry blocks to the outside.

It is believed to be clear that when the device for draining the hollow masonry block cells of a single wythe wall, and the single wythe wall itself, are configured and the method of mortar collection and water draining is performed in accordance with the present invention, the hollow cells of the masonry blocks of the single wythe wall are not clogged by the mortar and other debris and water penetrating into the cells or cavities freely escapes through a drainage weep hole channel formed, for example as a standard drainage weep hole at the base of the hollow cell of each masonry block. The fibrous, water-permeable bodies 8 are easy to install, they do not have to satisfy any layout requirements and therefore no special personnel are needed.

The masonry wall does not require a double wythe base course with flashings, which means that a stronger wall is achieved, since when a flashing course is installed, it breaks the mortar bond between the blocks. The invention can be used with both insulated and non-insulated units. It also can be used in conjunction with vertically reinforced walls, which is an important design criteria requirement of the latest building code specifications.

It will be understood that each of the elements described above, or two or more together, may also find a useful application in other types of constructions and methods differing form the types described above.

While the invention has been illustrated and described as embodied in a device for draining water, diverting mortar droppings/debris and protecting the weep device for a single wythe wall provided with the device, and a method of draining water from the single wythe wall, it is not intended to be limited to the details shown, since various modifications and structural changes may be made, without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device in combination with and for protecting a weep hole channel device located above a top surface of a foundation wall, draining water and directing mortar droppings/debris from a single wythe wall comprising:

said single wythe wall composed of a plurality of structural masonry elements having multiple courses including a bottom course, each masonry element forming at least one hollow inner cell, the bottom course of masonry elements resting on said top surface of said foundation wall without flashing and having inner cells thereof communicating with said weep hole channel device located below said bottom course of masonry elements above a top surface of said foundation wall;

a separate upwardly extending water-permeable body in each hollow inner cell in the bottom course masonry elements of said single wythe wall to permit water to pass through to said weep hole channel device while preventing passage of mortar and other debris;

each of said upwardly extending water-permeable bodies having a lower end substantially filling its cell area and covering an underlying drainage weep hole channel device and a tapering transverse cross section which decreases upwardly from said lower end to allow falling of the mortar and other debris in the respective inner hollow recess cells onto a surface around each of said upwardly extending water-permeable bodies but at the same time to prevent blockage of said drainage weep hole channel device;

whereby water in each of the inner cells of masonry blocks of the single wythe wall can flow through a respective one of said upwardly extending water-permeable bodies into the weep hole channel device and outside of the single wythe wall.

2. A device as defined in claim 1, wherein each of said upwardly extending water-permeable bodies has a pyramidal shape which is tapered upwardly to increase the inner surface cell area for more room of each of said upwardly extending water-permeable bodies for collection of the mortar and other debris.

3. A device as defined in claim 1, wherein each of said upwardly extending water-permeable bodies has a conical shape which is tapered upwardly to increase the inner surface area of the cells for more room of each of said upwardly extending water-permeable bodies for collection of the mortar and other debris.

4. A device as defined in claim 1, wherein each of said bodies has a truncated pyramidal shape.

5. A device as defined in claim 1, wherein each of said upwardly extending water-permeable bodies has a truncated tapered conical shape.

6. A device as in claim 1, wherein each of said upwardly extending water-permeable bodies includes a plurality of members of upwardly decreasing cross section.

7. A device as defined in claim 1, wherein each of said upwardly extending water-permeable bodies has a height sufficient to extend above the bottom course and into a next course.

8. The device as in claim 1 wherein each said body is fibrous.

9. The device as in claim 1 wherein each said upwardly extending body is texturized.

10. A single wythe wall, comprising the combination of:

a plurality of structural elements formed into rows with a bottom row and subsequent rows placed over said bottom row, each structural element forming at least one inner hollow cell in said bottom row communicating with outside through at least one drainage weep hole channel device below said bottom row of structural elements and above a top surface of a foundation wall;

said bottom row resting on said foundation wall without flashing;

said weep hole channel device draining water from each said inner hollow cell in said bottom row having a plurality of passages such as to permit water to pass through said passages and to prevent passing of mortar and other debris through said passages;

an upwardly extending water-permeable body in said inner hollow cell, said water-permeable body having a tapering transverse dimension section which decreases upwardly from a lower transverse cross section in direct contact with and covering substantially all of the drainage weep hole channel device, to allow and/or direct falling of the mortar and other debris in each of the inner hollow cells onto a surface surrounding each upwardly extending water-permeable body but at the same time to prevent falling of the mortar and other debris in the respective inner hollow cells into the drainage weep hole channel device;

whereby water in the inner hollow cells flows through each said body into the drainage weep hole channel device and outside of the single wythe wall.

11. A single wythe wall as defined in claim 10, wherein each upwardly extending water-permeable body has a pyramidal shape which is tapered upwardly to increase inner surface cavity area of each hollow cell for collection of the mortar and other debris, but still allows water to pass through to the base of the wall to the drainage weep hole channel device, a bottom of said body filling substantially all of a cross section of the hollow cell.

12. A single wythe wall as defined in claim 10, wherein each water-permeable body has a conical shape which is tapered upwardly to increase inner surface hollow cell area of each of said structural elements for collection of the mortar and other debris.

13. A single wythe wall as defined in claim 10, wherein each body has a truncated pyramidal shape.

14. A single wythe wall as defined in claim 10, wherein each of said upwardly extending water-permeable bodies has a truncated tapered conical shape.

15. A single wythe wall as in claim 10, wherein each said upwardly extending water-permeable bodies includes a plurality of members of upwardly decreasing cross section.

16. A single wall as defined in claim 10, wherein each said upwardly extending water-permeable bodies has a height adapted to exceed a height of at least one of the structural elements.

17. The single wythe wall as in claim 10 wherein each said upwardly extending body is fibrous.

18. The single wythe wall as in claim 10 wherein each said upwardly extending body is texturized.

19. A method of draining water from a single wythe wall and protecting a drainage weep channel device at a top surface of a foundation wall comprising the steps of:

forming said single wythe wall from a plurality of structural elements, said structural elements placed over one another and each forming at least one inner hollow cell, lowermost structural elements resting on said foundation wall through a mortar joint without flashing and the hollow cells of lowermost structural elements communicating with outside through at least one drainage weep hole channel device at a top surface of said foundation wall;

introducing into the inner hollow cells of said lowermost structural elements a separate upwardly extending water-permeable body having a plurality of passages to permit water to pass through said passages and to prevent passing of mortar and other debris through said passages; and, forming each said upwardly extending water-permeable body with a tapering transverse dimension which decreases upwardly from a lower transverse cross section substantially fully covering the drainage weep hole channel device completely to direct falling of the mortar and other debris in the inner hollow cell onto a surface surrounding each said upwardly extending water-permeable body;

whereby water entering each of the inner hollow cells of the lowermost structural elements will flow through said upwardly extending water-permeable body into the drainage weep hole channel device and outside of the single wythe wall.

20. The method of claim 19 in which each said upwardly extending body extends into one or more structural elements above said lowermost structural elements.

21. The method of claim 20 in which a bottom of the lower transverse cross section of said upwardly extending water-permeable body is in direct contact with said drainage weep hole channel in said upper surface of said foundation wall.

22. The method of claim 21 in which each said upwardly extending water-permeable body is conical in shape.

23. The method of claim 21 in which each said upwardly extending water-permeable body has a truncated pyramidal shape.

* * * * *